United States Patent [19]

Schildge, Jr.

[11] 4,125,978

[45] Nov. 21, 1978

[54] PARAPET REINFORCEMENT SYSTEM FOR BUILDINGS

[76] Inventor: Adam T. Schildge, Jr., 899 Green St., San Francisco, Calif. 94133

[21] Appl. No.: 831,999

[22] Filed: Sep. 9, 1977

[51] Int. Cl.[2] ..... E04C 3/10; E04H 9/02

[52] U.S. Cl. ..... 52/223 R; 52/73; 52/167

[58] Field of Search ..... 52/223 R, 223 L, 224–230, 52/73, 74, 78, 149, 167

[56] References Cited

U.S. PATENT DOCUMENTS

| | | | |
|---|---|---|---|
| 375,999 | 1/1888 | Jackson | 52/225 |
| 793,358 | 6/1905 | Doyle | 52/225 X |
| 2,510,958 | 6/1950 | Coff | 52/225 |
| 3,129,531 | 4/1964 | Connor | 52/167 X |
| 3,158,959 | 12/1964 | Ratliff | 52/226 |
| 3,427,811 | 2/1969 | White | 52/223 R |

FOREIGN PATENT DOCUMENTS

| | | | |
|---|---|---|---|
| 1,174,960 | 7/1964 | Fed. Rep. of Germany | 52/225 |

*Primary Examiner*—J. Karl Bell

*Attorney, Agent, or Firm*—Naylor, Neal & Uilkema

[57] ABSTRACT

Building parapets and sidewalls are reinforced independent of the floor thereof by interconnecting opposed parapets or walls with adjustable interconnectors comprising anchor plates, cables and turnbuckles. The connection ties the parapets or walls together against separation and outward destructive movement under the influence of earthquake force conditions.

7 Claims, 8 Drawing Figures

PARAPET REINFORCEMENT SYSTEM FOR BUILDINGS

SUMMARY OF THE INVENTION

The subject invention is particularly desirable for use in earthquake-prone areas in connection with the type of construction which is common as to existing buildings, i.e. in which there are wood roof joists and brick parapets and walls which are not connected to the joists. A typical occurrence during earthquakes is that the parapets and walls separate from the joists and fall to the ground.

A known expedient in the art to attempt to prevent such parapet separation is to attach retaining brackets to the parapets and anchor the retaining brackets to the roof joists. This necessitates either the use of scaffolding or the placement of an installation man in some fashion outside on the building walls. This method also entails the cutting through of the roof in many places to effect the anchoring connection to the roof joists, following which re-roofing is required.

Among the objects and advantages of the present invention are the following: the provision of a low-cost parapet and wall retention system; the provision of such a system further characterized by great simplicity as to component parts and installation procedure; the provision of such a retention system which is further characterized by flexibility as to installation, strength of the retention system, and the usage of basic and readily obtainable component parts and materials; the provision of a parapet and wall retention system of such nature that it can be installed by workers located only on the roof, i.e. not on external scaffolding or otherwise positioned on the outside of the building walls; and the provision of a parapet and wall retention system which does not involve any penetration or break-through of the already emplaced roof, thereby avoiding the need for re-roofing as a result of the installation of the retention system.

Other objects and advantages of the invention will be apparent from the following description taken in conjunction with the drawings forming part of this specification, and in which.

Figure 1:
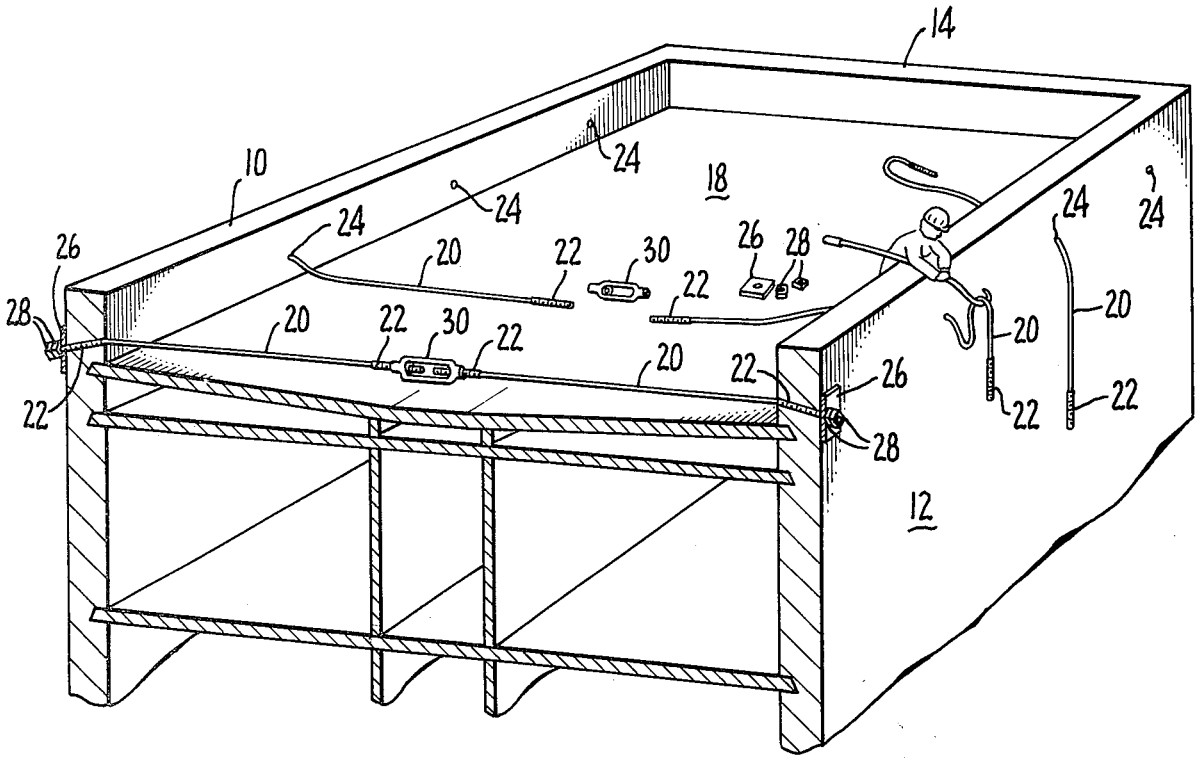
FIG. 1 is a view in perspective of a partial installation of the present wall and parapet retention system.

Referring to FIG. 1, a building is shown as having opposed sidewalls 10 and 12, opposed end walls 14 and 16 (FIG. 7) and a floor or roof 18. The upper portions, or parapets, of the wall pairs 10, 12 and 14, 16 are connected together by means comprising wire rope cables 20, threaded studs 22 swedge-connected to the cables 20, drill hole passageways 24 through which the outer elements 22 are passed, plates 26, nuts 28, and turnbuckle 30. The cables 20 are appropriately tensioned by adjustment of the turnbuckle 30 to cause the plates 26 to be urged into inward pressing engagement with the parapets to the extent necessary to meet safety requirements for parapet retention.

It will be noted that the drill hole passages 24 are inclined somewhat downwardly in the outward direction so as to locate the effective parapet and wall retaining forces closely adjacent the roof joist system.

Figure 2:
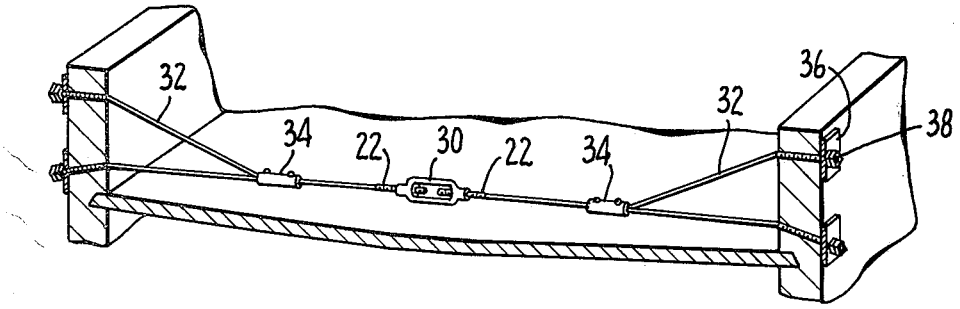
FIG. 2 is a view in perspective of a modification of the means employed in the retention system.

In the FIG. 2 modification of the anchoring system, secondary connections between opposed wall members are effected by wire ropes 32, wire rope tie clips 34, plates 36 and nuts 38. This system provides a substantial vertical dimension to the connection between the opposed parapets.

Figure 3:
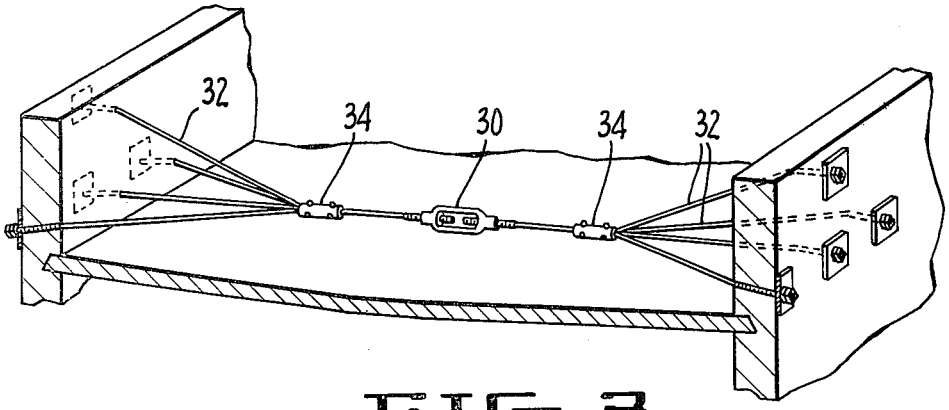
FIG. 3 is a view in perspective of a further modification of the means employed in the retention system.

In FIG. 3, the secondary cables 32 are shown as having proliferation both vertically and horizontally, thereby increasing the zone to zone interconnection area of the opposed parapets.

Figure 4:
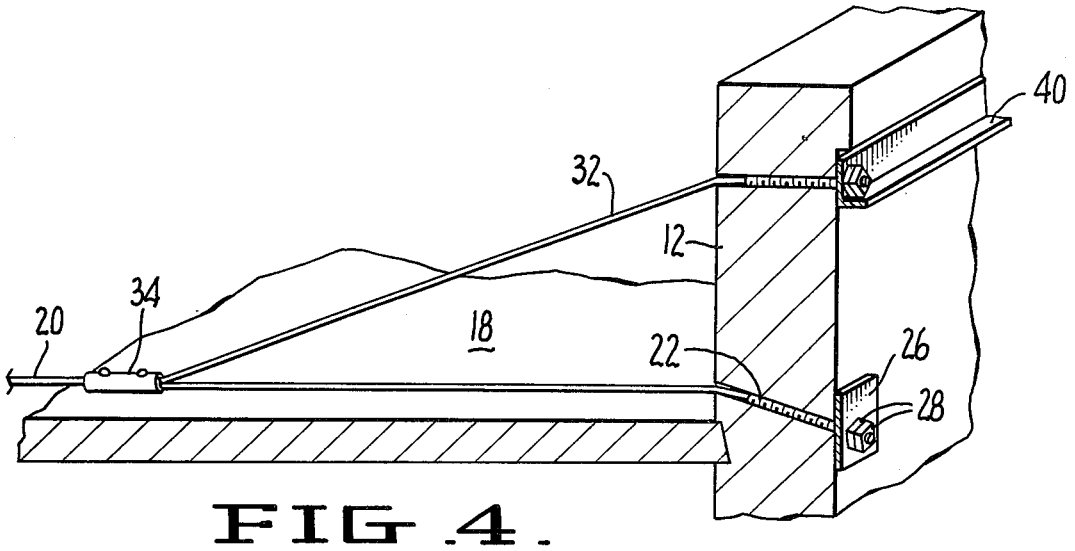
FIG. 4 is a view in perspective of a further modification of the means employed in the retention system.

In FIG. 4, the secondary cables 32 are connected to external channel members 40.

Figure 5:
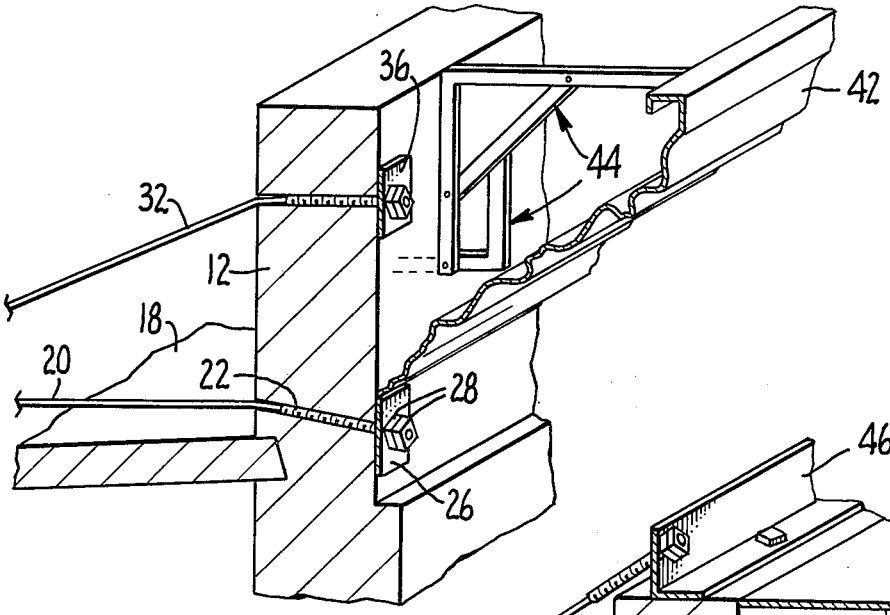
FIG. 5 is a view in perspective of a further modification of the means employed in the retention system.

Parapets are frequently provided with ornamental facades 42 attached thereto by support means 44. In FIG. 5, the parapet retention system of the invention is shown in installed relation to such facade-bearing parapets.

Figure 6:
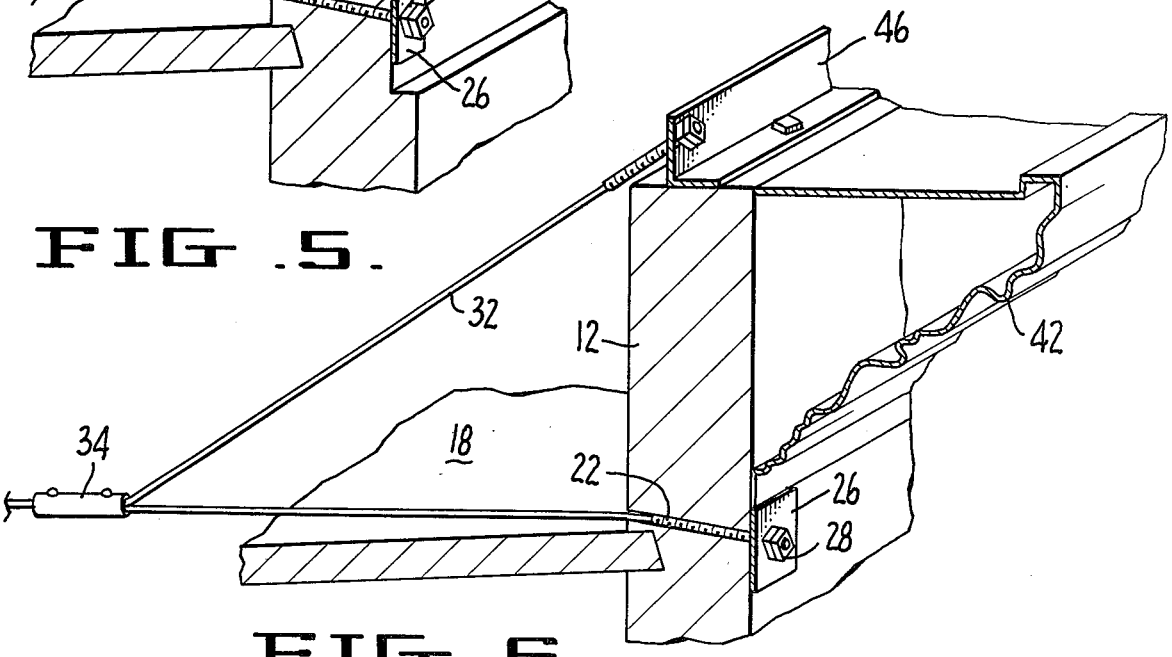
FIG. 6 is a view in perspective of a further modification of the means employed in the retention system.

In FIG. 6 there is shown another way of installing the subject parapet and wall retention system when the parapets are provided with ornamental facades 42. In this case angle elements 46 are fastened to the upper edges of the parapets and the secondary cables 32 are connected directly to the angle elements 46.

Figure 7:
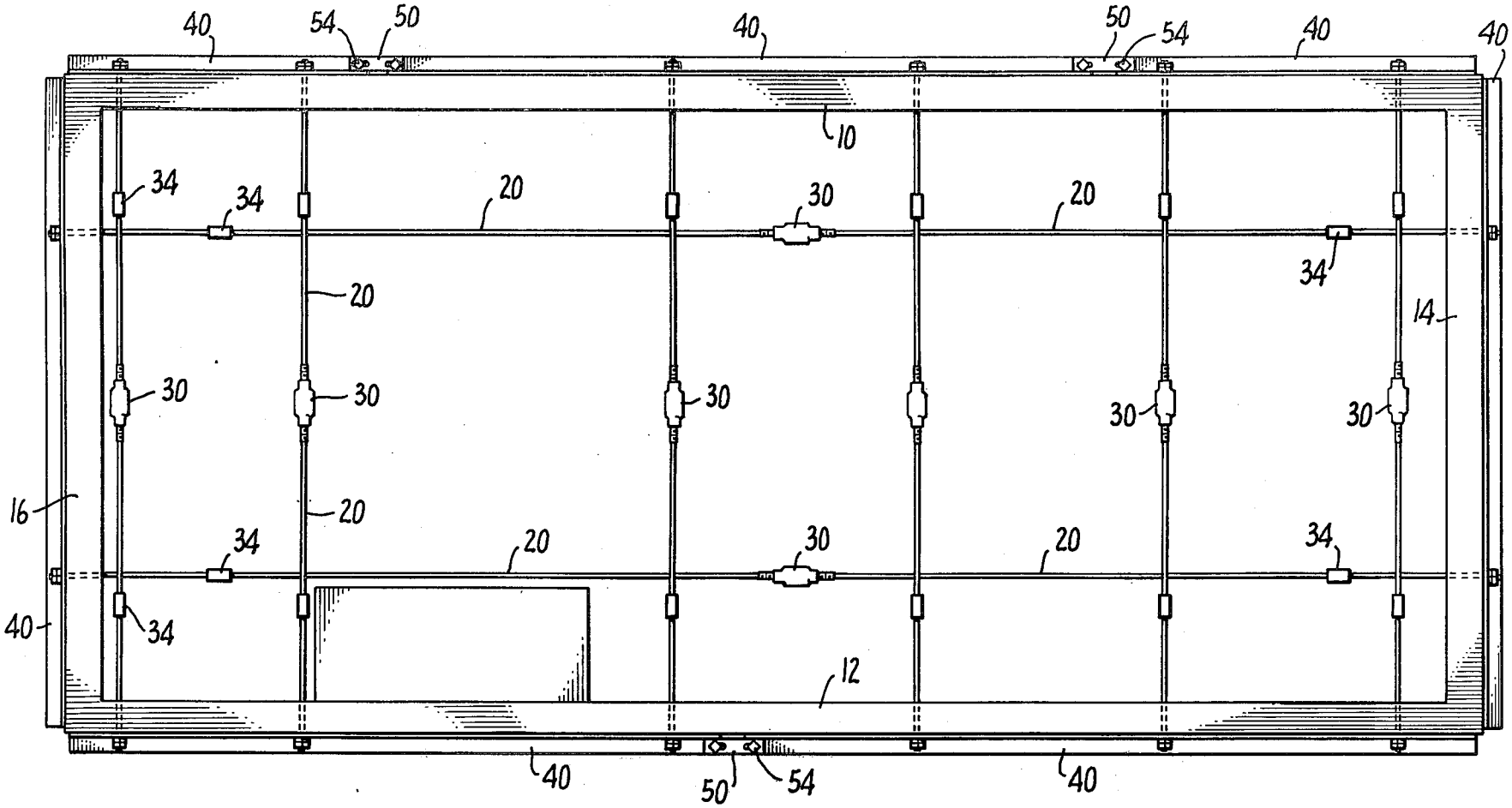
FIG. 7 is a top plan view of an overall installation of the retention system.

FIG. 7 shows the preferred form of retention system of FIG. 4 in full application to a building.

Figure 8:
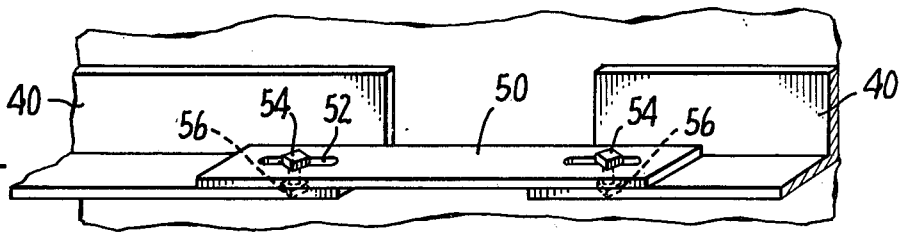
FIG. 8 is a view in perspective of a detail of the FIG. 7 installation.

As shown in FIG. 8, the angle elements 40 may be composed of separate sections interconnected by an adjustable bridging system comprising plates 50 having elongated slots 52, bolt holes in elements 40, bolts 54 and nuts 56.

The subject parapet and wall retention system is particularly adapted for use in reinforcing lift slab buildings against collapse in the event of an earthquake.

What is claimed is:

1. In a building comprising at least two pairs of opposed wall members and a floor disposed between the wall members and connected thereto, a method for supporting and reinforcing the wall members, said method comprising tying each pair of opposed wall members together independent of the floor so as to tie the wall members together to inhibit outward destructive movement of the wall members and separation thereof from the floor under the influence of earthquake force conditions.

2. In a building comprising at least two pairs of opposed parapet and wall members and a floor disposed between the members and connected thereto, a method of reinforcing the wall and parapet members, said method comprising interconnecting each pair of such opposed members with tying members to secure the opposed members together independent of the floor to inhibit outward destructive movement of the members and separation thereof from the floor under the influence of earthquake force conditions.

3. In combination with a building having at least two pairs of oppositely disposed building parapets and a floor disposed between the parapets and connected thereto, the improvement comprising: generally aligned drilled passageways formed in each pair of oppositely disposed parapets; a plurality of wire rope cables having swedged to the inner and outer ends thereof threaded studs, the studs at the outer ends of said cables extending through said passageways and having attached thereto anchor plates disposed against the outer sides of said parapets, and turnbuckle means adjustably threadably connected to the studs at the inner ends of said cables operative to connect the cables extending through aligned passageways and tie the parapets together against outward movement and separation from the floor under the influence of earthquake force conditions.

4. The combination of claim 3, said parapets being interconnected at spaced intervals by such passageways, cables, anchor plates and turnbuckle means.

5. The combination of claim 4, said cables and said passageways being disposed adjacent the bottom of said parapets, other cables connected to said parapets at a higher level on said parapets, said latter cables being connected to said first-mentioned cables and being maintained under parapet-supporting tension by said turnbuckle means.

6. The combination of claim 5, the outer ends of said other cables being attached to horizontally disposed, elongated cable-anchoring members bearing against the outside surfaces of said parapets.

7. In combination, a building having at least two pairs of oppositely disposed parapet and wall members and a floor disposed between and connected to the members, anchor plate means disposed against the outer sides of each of said members, cables extending between said oppositely disposed members independent of said floor and having their outer ends extending through said members into attached relation to said anchor plate means, and take-up means in said cables operative to maintain said anchor plate means in pressing relation to said members to inhibit outward destructive movement of the members and separation thereof from the floor under the influences of earthquake force conditions.

* * * * *